US005147601A

United States Patent [19]

Ohtsuka et al.

[11] Patent Number: 5,147,601

[45] Date of Patent: Sep. 15, 1992

[54] PROCESS FOR MANUFACTURING A SOFT MAGNETIC BODY OF AN IRON-NICKEL ALLOY

[75] Inventors: Akihito Ohtsuka, Sakura; Yoshio Kijima, Tokyo, both of Japan

[73] Assignee: Sumitomo Metal Mining Co., Ltd., Tokyo, Japan

[21] Appl. No.: 860,183

[22] Filed: Mar. 30, 1992

[30] Foreign Application Priority Data

Apr. 30, 1991 [JP] Japan ..... 126646

[51] Int. Cl.[5] ..... G22F 1/00

[52] U.S. Cl. ..... 419/25; 419/36; 419/37; 419/38; 419/57; 419/58; 419/60

[58] Field of Search ..... 419/25, 36, 37, 38, 419/57, 58, 60

[56] References Cited

U.S. PATENT DOCUMENTS 4,325,895 4/1982 Morris ..... 419/25
4,615,734 10/1986 Spriggs ..... 419/25
4,968,347 11/1990 Ramish ..... 419/25

*Primary Examiner*—Stephen J. Lechert, Jr.
*Attorney, Agent, or Firm*—Watson, Cole, Grindle & Watson

[57] ABSTRACT

A composition comprising a powder of iron and nickel and a binder (e.g. wax) is injection molded. The powder contains 0.5 to 10% by weight of nickel and has an average particle diameter not exceeding 45 microns. The binder is removed from the molded product. The molded product is sintered, and the sintered product is cooled to room temperature slowly at a rate of 2° C. to 50° C. per minute. The sintered product is of an iron-nickel alloy, has a high density and a high level of soft ferromagnetic properties, and may be complicated in shape.

6 Claims, No Drawings

PROCESS FOR MANUFACTURING A SOFT MAGNETIC BODY OF AN IRON-NICKEL ALLOY

BACKGROUND OF THE INVENTION

1. Field of the Invention

This invention relates to a process for manufacturing a body of an iron-nickel alloy having a complicated shape and exhibiting a high level of soft ferromagnetic properties.

2. Description of the Prior Art

Pure iron is a soft ferromagnetic material exhibiting a high saturation magnetic flux density and is widely used as a material for yokes in pulse motors, relays, printer heads, etc. Precision casting has been employed for making a part of pure iron. It has, however, been likely that a defective casting may be made, as the desired dimensional accuracy of sharp edges or points is difficult to obtain. Attempts have, therefore, been made to employ powder metallurgy for making, among others, parts having complicated shapes.

It is, however, impossible to make a product of pure iron having a complicated three-dimensional shape by any ordinary method of powder metallurgy relying upon compression molding. As it is necessary from a compressibility standpoint to use a relatively coarse powder having an average particle diameter of, say, 100 microns, and as pure iron is not easily diffusible, it is difficult to a product having a sintered density which is sufficiently high to realize the desired magnetic properties. It is necessary to compress and sinter a sintered product again to increase its density, or it is necessary to rely upon prolonged sintering, or hot isotactic pressing (HIP). If it is necessary to give a sintered product a dimensional finish by machining, it is necessary to heat treat it thereafter to relieve it of any resulting stress.

SUMMARY OF THE INVENTION

Under these circumstances, it is an object of this invention to provide a process which enables the easy and reliable manufacture of a sintered body of an iron-nickel alloy having a high density, a complicated shape, and a high level of soft ferromagnetic properties.

We, the inventors of this invention, have found after a great deal of research work that the above object can be attained by injection molding a composition comprising a mixture of iron and nickel powders having specific ranges of proportion and particle diameter, or an appropriate powder of an iron-nickel alloy, and a binder, removing the binder from the molded product, sintering it, and cooling it slowly at a specific cooling rate so that no lattice strain occurring upon cooling may bring about any lowering in the soft ferromagnetic properties of the product.

According to this invention, therefore, there is provided a process for manufacturing a soft magnetic body of an iron-nickel alloy which comprises injection molding a composition comprising a powder containing 0.5 to 10% by weight of nickel, the balance of the powder being substantially iron, and having an average particle diameter not exceeding 45 microns, and a binder, removing the binder from the molded product, sintering it, and cooling the sintered product slowly at a rate of 2° C. to 50° C. per minute.

Other features and advantages of this invention will become apparent from the following description.

DETAILED DESCRIPTION OF THE INVENTION

The composition to be injection molded comprises a powder comprising iron and nickel, and a binder. It is desirable for the powder not to contain any other element than iron and nickel, though the powder may contain any other element to the extent that it is possible to make a sintered product having a magnetic flux density, $B_{35}$, which is not lower than 12,500 G.

The powder, as well as the sintered product thereof, is required to have a nickel content of 0.5 to 10% by weight. If its nickel content is less than 0.5% by weight, it is hardly possible to obtain a final product having an improved relative density and exhibiting a high level of soft ferromagnetic properties. If its nickel content is over 10% by weight, the sintered product has a lower magnetic flux density, though its relative density may be improved.

The powder is required to have an average particle diameter not exceeding 45 microns. If its average particle diameter exceeds 45 microns, the composition is so low in flowability that its injection molding is hardly possible, and even if its injection molding may be possible, the molded product can be sintered only so late that the sintered product does not readily achieve an improved final density, but undergoes a great lowering in magnetic properties.

It is generally possible to use as the binder any of the known materials which are used as a binder to prepare an injection molded product for powder metallurgy. If the removal of the binder leaves any carbon, however, it enters the iron-nickel alloy and lowers its magnetic properties. It is, therefore, advisable to use a binder which does not readily form carbon, for example, one consisting mainly of wax. The composition preferably contains less than 50% by volume of binder.

Heat or solvent degreasing, or any other method may be employed for removing the binder from the molded product. The method to be employed depends on the binder to be removed. It is, however, preferable to employ heat degreasing in a nitrogen or hydrogen atmosphere, or in a vacuum, particularly if the process is carried out on a mass-production basis, since this method can be carried out by an apparatus which is simpler than that which is employed for any other method.

The molded product from which the binder has been removed may be sintered by holding at a temperature of 1200° C. to 1500° C. for a period of 30 to 180 minutes in a hydrogen atmosphere, or in a vacuum.

The sintered product is cooled slowly at a rate of 2° C. to 50° C. per minute. No cooling rate that is lower than 2° C. per minute is of any significant effect against the occurrence of lattice strain. Too low a cooling rate is also undesirable from an economical standpoint, as it results in lower productivity. Cooling at a rate over 50° C. per minute produces lattice strain which remains unremoved even at room temperature, and thereby lowers the soft ferromagnetic properties of the sintered product.

The invention will now be described more specifically with reference to a few examples thereof, as well as a few comparative examples.

EXAMPLE 1

An iron carbonyl powder having an average particle diameter of 6 microns and a nickel carbonyl powder having an average particle diameter of 5 microns were mixed in such proportions as to produce an iron-nickel alloy containing 2% by weight of nickel. The mixture thereof was kneaded with a binder consisting mainly of wax at a temperature of 150° C. The binder was used in such an amount as to occupy 45% by volume of the kneaded mixture as a whole. The kneaded mixture was formed into pellets. The pellets were injection molded at a pressure of 1200 kg/cm$^2$ to form a molded product in the shape of a ring having an outside diameter of 16 mm, an inside diameter of 8 mm and a height of 10 mm.

The molded product was heated to 300° C., whereby the binder was removed therefrom. Then, it was sintered at 1350° C. for two hours, and the sintered product was cooled to room temperature at a rate of 10° C. per minute.

An exciting coil and a search coil each consisting of 50 turns were wound on the sintered product, and its magnetic flux density ($B_{35}$), coercive force ($H_c$), and maximum permeability ($\mu$ max) were measured in an external magnetic field having a strength of 35 Oe, while its BH hysteresis curve was drawn by a DC recording magnetic flux meter. Its sintered density was also determined. The results, as well as the conditions of manufacture, are shown in TABLE 1.

EXAMPLE 2

EXAMPLE 1 was repeated for making a sintered product and evaluating it, except that the iron and nickel carbonyl powders were mixed in such proportions as to produce an alloy containing 5.0% by weight of nickel. The results of its evaluation are shown in TABLE 1.

EXAMPLE 3

EXAMPLE 1 was repeated for making and evaluating a sintered product, except that the iron and nickel carbonyl powders were mixed in such proportions as to produce an alloy containing 8.0% by weight of nickel. The results of its evaluation are shown in TABLE 1.

COMPARATIVE EXAMPLE 1

EXAMPLE 1 was repeated for making and evaluating a sintered product, except that the iron and nickel carbonyl powders were mixed in such proportions as to produce an alloy containing 0.2% by weight of nickel, which is less than the lower limit of the nickel range as defined by this invention, or 0.5% by weight. The results of its evaluation are shown in TABLE 1. As is obvious therefrom, it was inferior in magnetic properties, particularly magnetic flux density ($B_{35}$), because of its low density.

COMPARATIVE EXAMPLE 2

EXAMPLE 1 was repeated for making and evaluating a sintered product, except that the iron and nickel carbonyl powders were mixed in such proportions as to produce an alloy containing 12.0% by weight of nickel, which is over 10% by weight, or the upper limit of the nickel range as defined by this invention. The results of its evaluation are shown in TABLE 1. It was inferior in, among others, magnetic flux density ($B_{35}$).

COMPARATIVE EXAMPLE 3

EXAMPLE 1 was repeated for making and evaluating a sintered product, except that the sintered product was oil quenched at a cooling rate of 100° C. per minute, which is higher than 50° C. per minute, or the upper limit of the cooling rate as defined by this invention. The results of its evaluation are shown in TABLE 1. It was by far inferior in magnetic properties, exhibiting low magnetic flux density ($B_{35}$), low permeability ($\mu$ max), and high coercive force ($H_c$).

COMPARATIVE EXAMPLE 4

EXAMPLE 1 was repeated for making and evaluating a sintered product, except for the use of an iron carbonyl powder having an average particle diameter of 50 microns, which is larger than 45 microns, or the upper limit of the average particle diameter as defined by this invention. The results of its evaluation are shown in TABLE 1. It was inferior in magnetic properties because of its low density.

The results shown in TABLE 1 confirm the superiority in magnetic properties of the sintered products made in accordance with this invention.

| | Conditions of manufacture | | | | | | | | |
|---|---|---|---|---|---|---|---|---|---|
| | | Average particle diameter (μm) | | | | | Magnetic properties | | |
| | Alloy compositions | Ion carbonyl power | Nickel carbonyl powder | Sintering temperature (°C.; for 2 hrs) | Cooling rate (°C./min) | Sintered density | B35 (KG) | Hc (Oe) | μmax (G/Oe) |
| Example 1 | 2.0 wt % Ni—Fe | 6 | 5 | 1350 | 10 | 90.2 | 13.9 | 2.6 | 2000 |
| Example 2 | 5.0 wt % Ni—Fe | 6 | 5 | 1350 | 10 | 91.1 | 13.3 | 2.3 | 2800 |
| Example 3 | 8.0 wt % Ni—Fe | 6 | 5 | 1350 | 10 | 91.8 | 12.7 | 2.1 | 3100 |
| Comparative Example 1 | 0.2 wt % Ni—Fe | 6 | 5 | 1350 | 10 | 88.1 | 12.4 | 2.7 | 1850 |
| Comparative Example 2 | 12.0 wt % Ni—Fe | 6 | 5 | 1350 | 10 | 92.2 | 11.2 | 2.0 | 3000 |
| Comparative Example 3 | 2.0 wt % Ni—Fe | 6 | 5 | 1350 | 100 | 90.2 | 10.6 | 3.8 | 950 |
| Comparative Example 4 | 2.0 wt % Ni—Fe | 50 | 5 | 1350 | 10 | 80.6 | 11.1 | 2.9 | 1200 |

What is claimed is:

1. A process for manufacturing a soft magnetic body of an iron-nickel alloy which comprises:

injection molding a composition comprising a powder containing 0.5 to 10% by weight of nickel and having an average particle diameter of at most 45 microns, and a binder, the balance of said powder being substantially iron;

removing said binder from the molded product of said composition;

sintering said product; and cooling said sintered product at a rate of 2° C. to 50° C. per minute.

2. A process as set forth in claim 1, wherein said composition contains less than 50% by volume of said binder.

3. A process as set forth in claim 1, wherein said binder consists mainly of wax.

4. A process as set forth in claim 1, wherein said removing of said binder is carried out by the degreasing of said molded product under heat in a nitrogen or hydrogen atmosphere, or in a vacuum.

5. A process as set forth in claim 1, wherein said removing of said binder is carried out by the solvent degreasing of said molded product.

6. A process as set forth in claim 1, wherein said sintering is carried out by holding said molded product at a temperature of 1200° C. to 1500° C. for a period of 30 to 180 minutes in a hydrogen atmosphere, or in a vacuum.

* * * * *